US006703984B2

(12) United States Patent
Schadler

(10) Patent No.: US 6,703,984 B2
(45) Date of Patent: Mar. 9, 2004

(54) COMMON APERTURE UHF/VHF HIGH BAND SLOTTED COAXIAL ANTENNA

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/082,267

(22) Filed: Feb. 26, 2002

(65) Prior Publication Data

US 2002/0126060 A1 Sep. 12, 2002

Related U.S. Application Data

(63) Continuation-in-part of application No. 09/800,998, filed on Mar. 8, 2001, now Pat. No. 6,373,444.

(51) Int. Cl.[7] ..... H01Q 13/10
(52) U.S. Cl. ..... 343/770; 343/768
(58) Field of Search ..... 343/770, 771, 343/767, 768, 890, 891

(56) References Cited

U.S. PATENT DOCUMENTS 3,975,733 A * 8/1976 Bogner ..... 343/770
4,590,480 A * 5/1986 Nikolayuk et al. ..... 343/771
5,929,821 A * 7/1999 Goldstein et al. ..... 343/770
6,166,774 A * 12/2000 Plonka ..... 348/487

* cited by examiner

*Primary Examiner*—Don Wong
*Assistant Examiner*—Shih-Chao Chen
(74) *Attorney, Agent, or Firm*—Baker & Hostetler LLP

(57) ABSTRACT

A slotted coaxial antenna design that accomplishes simultaneous DTV and NTSC broadcast with minimal tower windloading is disclosed. In a preferred embodiment, the antenna design includes a VHF slotted coaxial antenna that acts as a framework to house multiple UHF slotted coaxial antennas, wherein the beam tilt of each UHF antenna can be independently adjusted. The one or more UHF slotted coaxial antennas, which each acts as an UHF outer conductor, and the one or more VHF couplers, which surround the VHF inner conductor, configure an arrangement such that the UHF antennas and VHF couplers share a common aperture, namely, the VHF antenna. This antenna design allows for high band VHF/UHF broadcast of DTV and NTSC signals while being easily adaptable to existing slotted coaxial antennas.

21 Claims, 12 Drawing Sheets

COMMON APERTURE UHF/VHF HIGH BAND SLOTTED COAXIAL ANTENNA

This application is a continuation-in-part (CIP) application of U.S. patent application Ser. No. 09/800,998 filed Mar. 8, 2001, now U.S. Pat. No. 6,373,444.

FIELD OF INVENTION

The present invention generally relates to the field of slotted coaxial antenna designs. More particularly, the present invention relates to the design of a slotted coaxial antenna that allows for simultaneous DTV and NTSC broadcast with equal or less windload than present VHF only antenna designs.

BACKGROUND OF THE INVENTION

The majority of Ultra High Frequency (UHF) antennas used in National Television System Committee (NTSC) antenna systems are slotted coaxial designs. UHF slotted coaxial antennas gained widespread use in NTSC broadcasting because of their above-average performance characteristics, such as excellent omni-directional azimuth patterns and smooth null fill. Further, because UHF slotted coaxial antennas do not have any components that protrude from it, such as batwings or dipoles and is simply cylindrical in nature, the total antenna area susceptible to wind forces is less than VHF only antennas. Thus, the windloads on UHF slotted coaxial antennas are substantially less than the windloads on VHF only antennas.

While the foregoing performance characteristics are also desirable for digital television (DTV) transmission, the more stringent antenna output performance standards of DTV transmission cannot be met with current slotted coaxial antenna designs. At the present stage of antenna development, the antenna output response performance across multiple channels, which was given little consideration in NTSC systems, is now an important parameter for DTV transmission.

For example, when used as television broadcasting antennas, slotted coaxial antennas are generally optimized to transmit signals for a specified television channel having a six MHz bandwidth. For NTSC transmission, the power distribution across this six MHz bandwidth is concentrated at three basic carrier frequencies; namely, picture, color and aural. Therefore, the performance of the antenna is critical only at these three carrier frequencies.

However, for DTV transmission, the power is equally distributed across a 5.4 MHz bandwidth span within the 6 MHz bandwidth. Therefore, the antenna's performance is critical across the operating band. This means that the antenna's elevation pattern must remain stable (i.e., unchanged) at all frequencies within the channel, and not just at isolated frequencies.

In addition, there are over 400 Very High Frequency (VHF) television stations that have already been assigned UHF DTV channels. As a practical matter then, the onset of DTV has thus complicated the antenna selection decision for broadcasters who must now operate DTV antenna systems simultaneously with their existing NTSC antenna systems. It is desirable therefore to provide a coaxial antenna similar in nature to a slotted coaxial UHF antenna that allows for simultaneous DTV and NTSC broadcast with equal or less tower windloading than present VHF only antennas.

Further, the environment around the antenna may vary from one direction to another. For example, the ground level in one direction may be higher than the ground level in another direction at that site. Accordingly, it is also desirable to provide an antenna wherein the beam tilts of the UHF antennas can be independently adjusted in different directions.

SUMMARY OF THE INVENTION

The antenna of the present invention satisfies to a great extent the foregoing need for an improved slotted coaxial antenna design.

In one aspect of the invention a slotted coaxial antenna constituting a replacement antenna useful as a DTV and NTSC antenna system, is provided. The slotted coaxial antenna comprises an elongated cylindrical hollow mast. The mast acts as an outer conductor.

On the outside of the mast is arranged a plurality of substantially equidistant longitudinally extending spaced slots. In one embodiment, there are four VHF coupled slots and four UHF coupled slots arranged in alternating fashion. Each slot is formed in the mast for the purpose of radiating electromagnetic energy. Alternatively and optionally, each slot in the cylindrical mast may be of varying width and length for the purpose of varying the radiating field and ultimately the usable bandwidth of the antenna.

On the inside, the mast coaxially surrounds a longitudinally extending VHF inner conductor, which consists of a VHF slotted coaxial antenna. In one embodiment, the VHF inner conductor is surrounded equidistantly by four UHF slotted coaxial antennas, which each acts as a UHF outer conductor contained within the mast. Interposed between each UHF slotted coaxial antenna is a VHF coupler (also totaling four) such that the four UHF antennas and the four VHF couplers share a common aperture, namely, the VHF antenna. Each coupler (VHF or UHF) is located on the inside of the mast between the ends of each longitudinal slot.

A significant result of this slotted coaxial antenna design is an antenna output response performance that is suitable for VHF high band and UHF DTV broadcasts.

Another significant result is the achievement of DTV and NTSC signal coverage with equal or less tower windloading than current VHF only antennas.

In another aspect of the invention an antenna is provided that includes an elongated hollow mast having an upper portion and a lower portion, a VHF coupled slot in an outer periphery of the mast, a UHF coupled slot in the outer periphery of the mast, and a feed point, wherein the location of the feed point is between the upper portion and the lower portion.

In another aspect of the invention, an antenna is provided that includes a means for transmitting a VHF signal and a UHF signal simultaneously from the antenna, a means for dividing the antenna into an upper portion and to a lower portion, and a means for feeding the UHF signal to the upper portion and to the lower portion of the antenna.

In another aspect of the invention a method for transmitting signals from an antenna is provided that includes transmitting a VHF signal and a UHF signal simultaneously from the antenna, dividing the antenna into an upper portion and a lower portion utilizing a feed point, feeding the UHF signal to the upper portion and the lower portion of the antenna, utilizing the feed point, and varying a beam tilt of the antenna by moving the feed point between the upper portion and the lower portion.

As a practical matter, the common aperture UHF/VHF high band slotted coaxial antenna of the present invention also results in substantial economic savings, since the broadcast of NTSC and DTV signals can be transmitted from one common antenna. Moreover, it is adaptable to existing slotted coaxial antennas.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE PREFERRED EMBODIMENTS

DETAILED DESCRIPTION OF PREFERRED EMBODIMENTS

Figure 1:
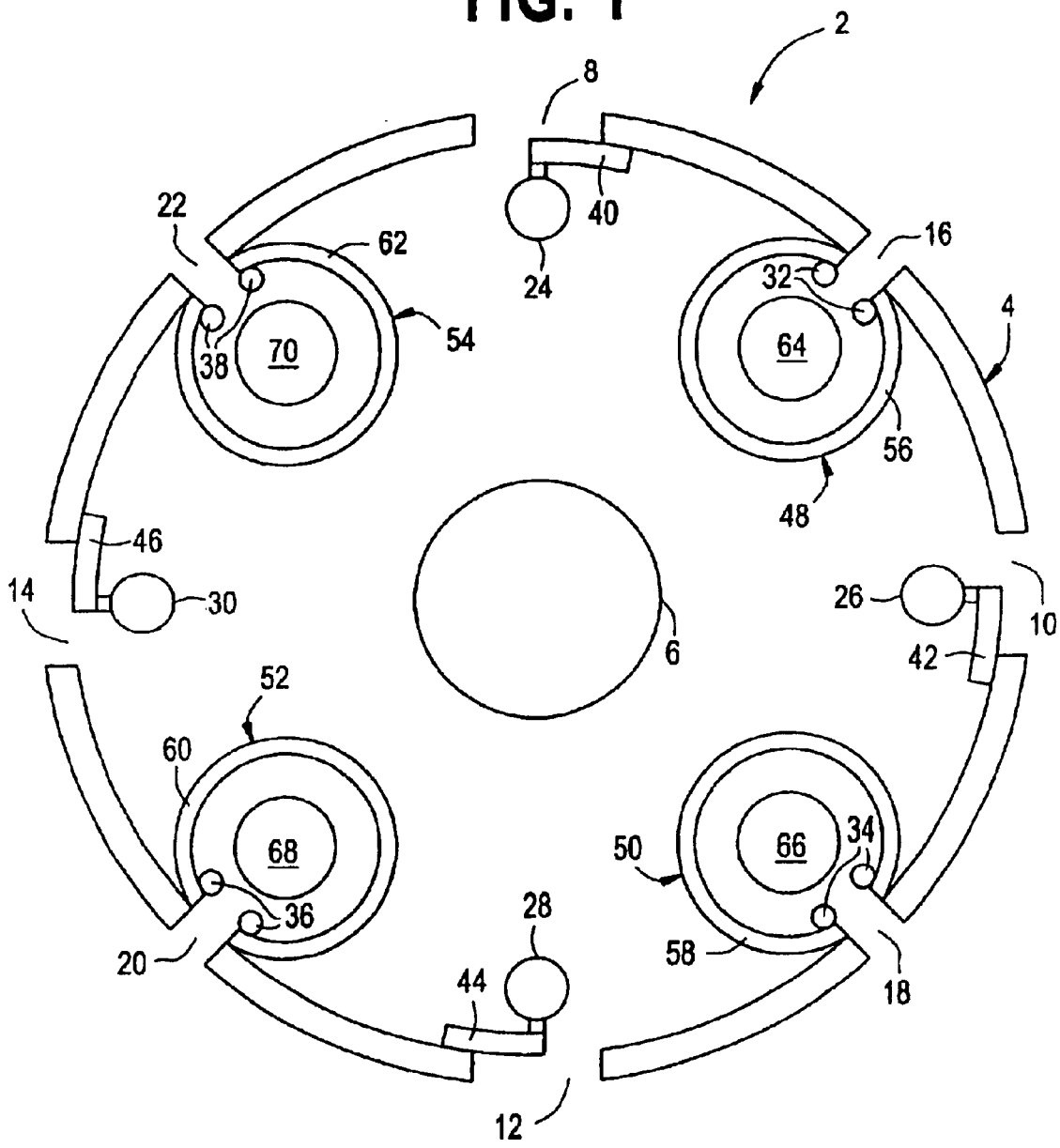
FIG. 1 is a top view of a common aperture UHF/VHF high band slotted coaxial antenna in accordance with a preferred embodiment of the present invention.

Referring now to the figures wherein like reference numerals indicate like elements, in FIG. 1, there is shown one embodiment of a high band VHF/UHF common aperture slotted coaxial antenna 2. The common aperture slotted coaxial antenna 2 comprises an elongate, cylindrical hollow mast 4, which surrounds a VHF slotted coaxial antenna that acts as a VHF inner conductor 6. The mast 4 acts as an outer conductor.

A plurality of longitudinally spaced slots 8, 10, 12, 14, 16, 18, 20, 22 are formed on the outside of the mast. Four are VHF coupled slots 8, 10, 12, 14, and four are UHF coupled slots 16, 18, 20, 22. Each VHF slot 8, 10, 12, 14 is arranged in an alternating fashion to the UHF slots 16, 18, 20, 22, as shown in FIG. 1.

On the inside, the mast 4 comprises a plurality of couplers 24, 26, 28, 30, 32, 34, 36, 38, one or more of which is associated with each UHF or VHF slot 8, 10, 12, 14, 16, 18, 20, 22. More specifically, the VHF couplers 24, 26, 28, 30 are disposed immediately adjacent VHF slots 8, 10, 12, 14. Similarly, the UHF couplers 32, 34, 36, 38 are arranged immediately adjacent UHF slots 16, 18, 20, 22.

Construction of the VHF couplers 24, 26, 28, 30 differs from the construction of the UHF couplers 32, 34, 36, 38. Each VHF coupler 24, 26, 28, 30 is suitably secured to the inside of mast 4 by an L-shaped bracket 40, 42, 44, 46, respectively, preferably made of aluminum. The VHF couplers 24, 26, 28, 30, via brackets 40, 42, 44, 46, respectively, are arranged to extend inside a portion of the length of the associated VHF slots 8, 10, 12, 14, respectively.

On the other hand, each UHF coupler 32, 34, 36, 38 comprises two cylindrical coupler rods, which form a part of the four UHF antennas 48, 50, 52, 54, respectively. As shown in FIG. 1, each cylindrical coupler rod 32, 34, 36, 38 is arranged opposite each other along a portion of the length of the associated UHF slot 16, 18, 20, 22, respectively. In addition, each cylindrical coupler rod 32, 34, 36, 38 has a space there between, which space corresponds to the width of the associated slot 16, 18, 20, 22, respectively. This space is the only opening in the UHF antennas 48, 50, 52, 54, respectively.

Each UHF antenna 48, 50, 52, 54 comprises an outer conductor 56, 58, 60, 62, respectively, and an inner conductor 64, 66, 68, 70, respectively. By the above-mentioned arrangement, the VHF outer conductor acts as a common aperture for the four alternating UHF slotted coaxial antennas 48, 50, 52, 54 and VHF couplers 24, 26, 28, 30 that are located inside of the mast 4.

Figure 2:
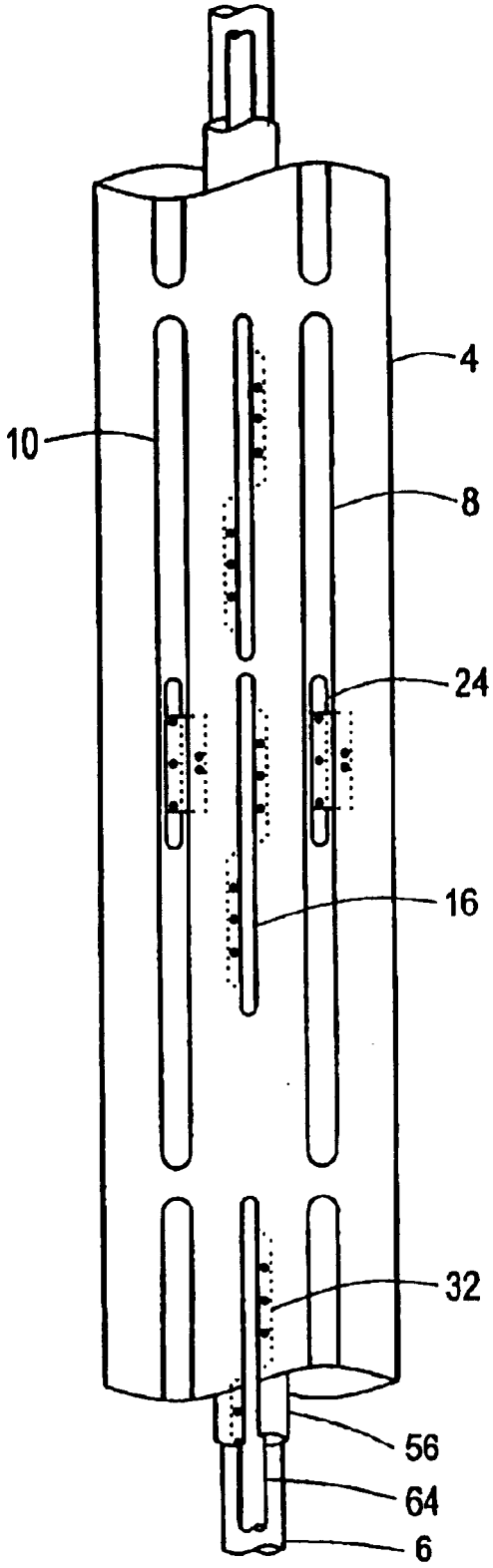
FIG. 2 is a front view of the slotted coaxial antenna of FIG. 1.

Referring now to FIG. 2, there is shown a front view of the improved slotted coaxial antenna design of FIG. 1. There is shown, for example, the elongate, hollow mast 4 having a plurality of longitudinally spaced VHF slots 8 and a plurality of longitudinally spaced UHF slots 16. In an exemplary embodiment of the present invention there are four columns of longitudinally spaced UHF slots 16 spaced around the slotted coaxial antenna 2 of the present invention. The mast 4 is constructed of a suitable material, such as steel or aluminum.

In a preferred embodiment, each slot in the cylindrical mast 4 may be of varying width and length for the purpose of varying the radiating field and ultimately the usable band width of the antenna. VHF slot 10 is shown to have an approximate length more than twice the length of two UHF coupled slots 16. The reason for this configuration is because the wavelength of the carrier frequencies for the VHF high band (i.e., channels 7 to 13) is more than twice the wavelengths of the carrier frequencies for the UHF band (i.e., channels 14 to 69).

Employing two couplers 32 in the UHF slot 16 also serves to produce more coupling from the smaller diameter couplers 32. Note that a single coupler may be used in each UHF slot 16. However, using a single coupler would require a larger sized diameter coupler, which may not feasible. Given the space restriction, use of a single coupler would lead to undesirable power handling issues.

Moreover, each slot is associated with a particular UHF or VHF coupling mechanism. Within VHF slot 8, for example, is shown a VHF coupler 24.

FIG. 2 also illustrates the VHF inner conductor 6, which is surrounded by a plurality of similarly situated UHF antennas having an outer conductor 56 and an inner conductor 64.

Figure 3:
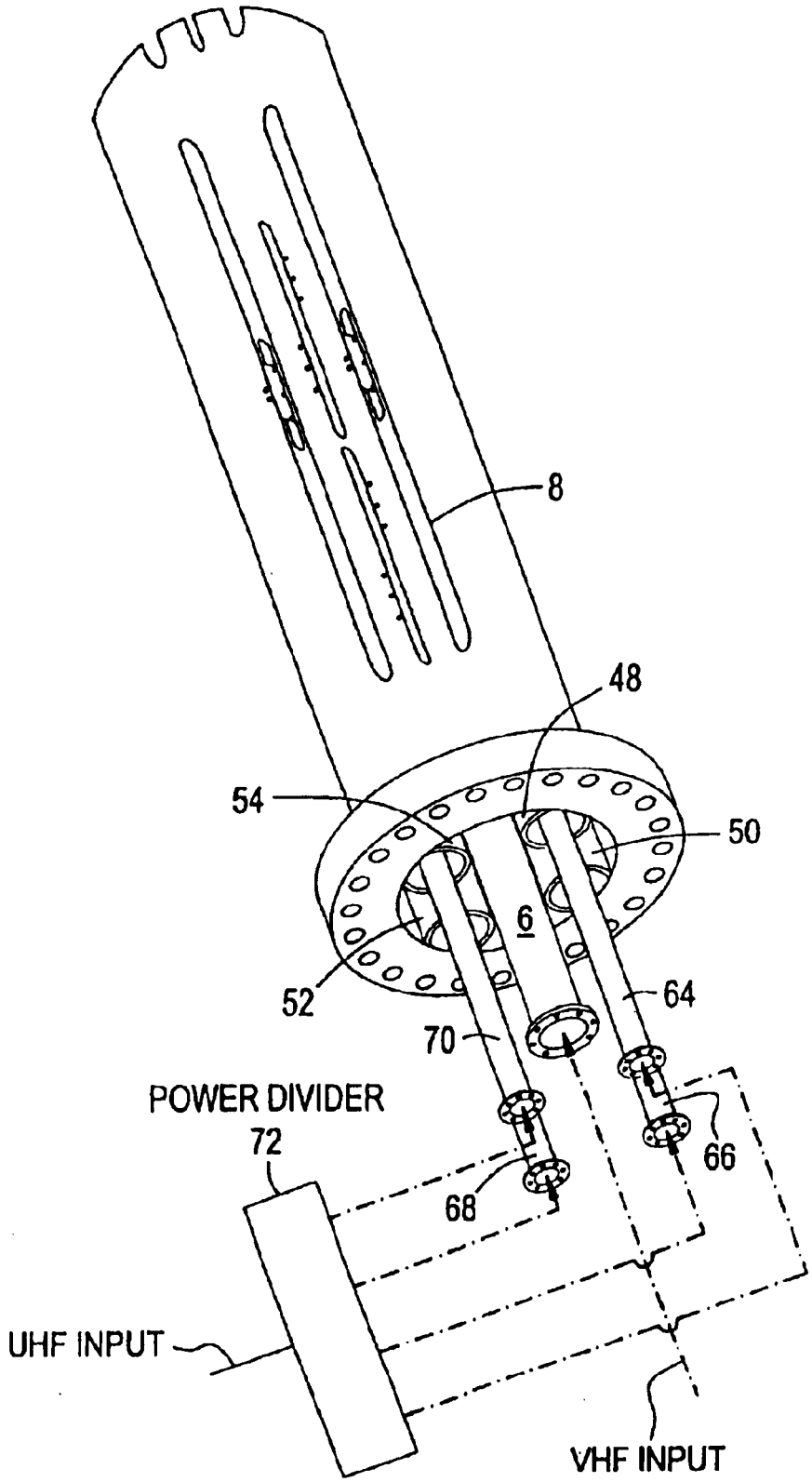
FIG. 3 is a side perspective view of the slotted coaxial antenna of FIG. 1.

FIG. 3 is a side perspective view of the improved slotted coaxial antenna of FIG. 1, illustrating the approximate spatial arrangement of the UHF antennas 48, 50, 52, 54. FIG. 3 also illustrates the concept of employing a power divider 72 if more than a single, internally attached UHF exists. In an exemplary embodiment of the present invention, the power divider 72 is used to change the UHF input to the slotted coaxial antenna 2 from one to four where each one of the four UHF inputs feeds a column of longitudinally spaced UHF slots 16. It should be understood that there may be any number of UHF feeds.

It is important to recognize that by changing one or a combination of factors, a multitude of azimuth patterns can be achieved for both UHF and VHF broadcast. These factors include: the outer mast diameter; the number of slots (both UHF and VHF) around the mast; the position of the UHF and VHF slots around the mast; addition of fins to the mast; and external lines (i.e., metallic lines running the full length of the antenna) placed in the aperture. Any one of these factors can be used as a successful method of scattering the antenna's radiation and consequently changing the shape of the azimuth patterns of the slotted coaxial antenna.

FIGS. 4 through 10 illustrate how variations in the above-mentioned factors shape or directionalize both the azimuth pattern of the VHF radiating channel and the UHF radiating channel. These figures show that the VHF and UHF azimuth patterns do not necessarily have to be the same shape. In effect, since the UHF and VHF slots work independently of each other, their patterns can be shaped in numerous combinations.

Figure 4:
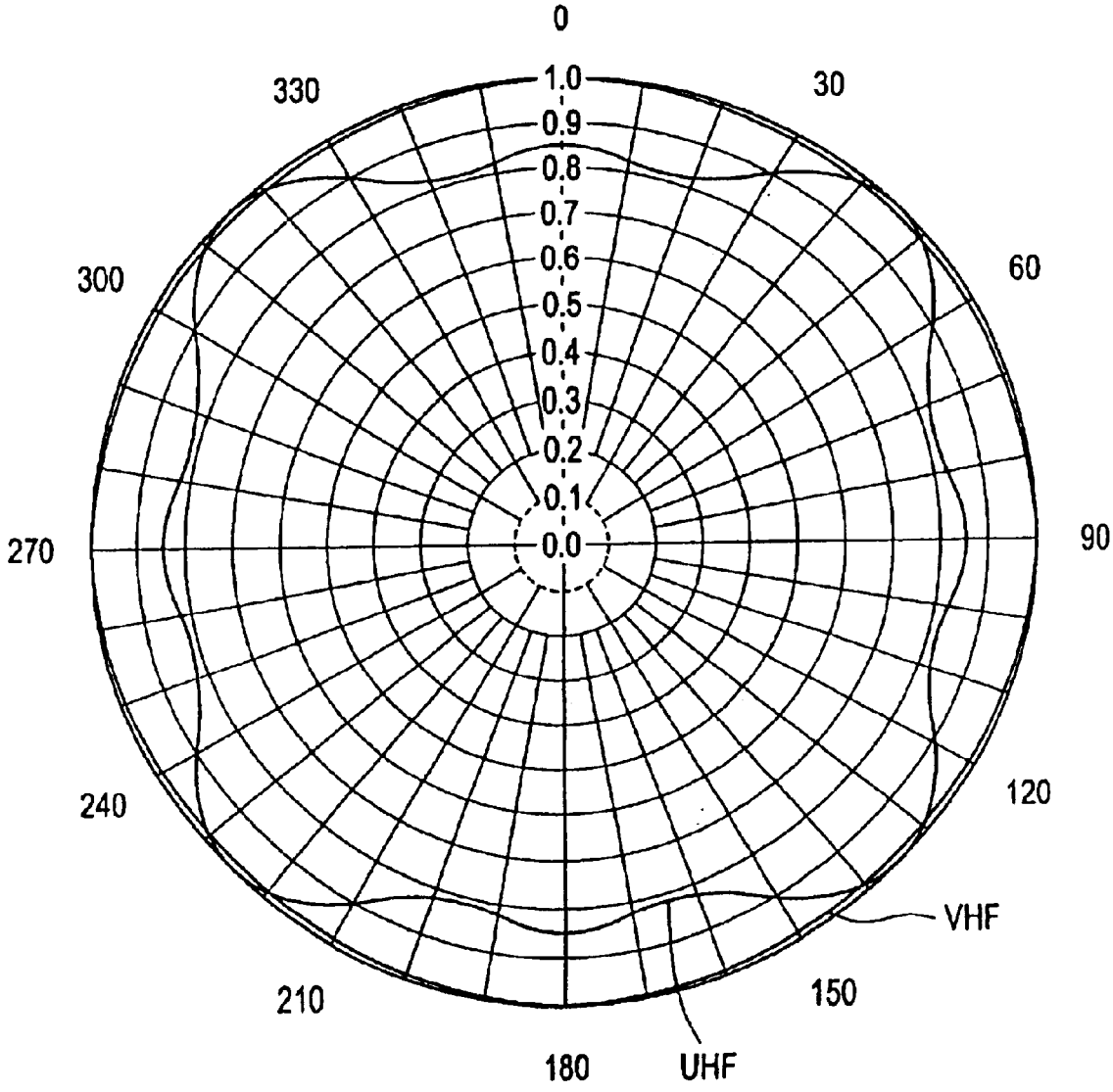
FIG. 4 is a graph depicting the UHF and VHF azimuth patterns corresponding to the slotted coaxial antenna design of FIG. 1.

For instance, the azimuth pattern corresponding to the slotted coaxial antenna design of FIG. 1 is shown in FIG. 4.

Figure 5:
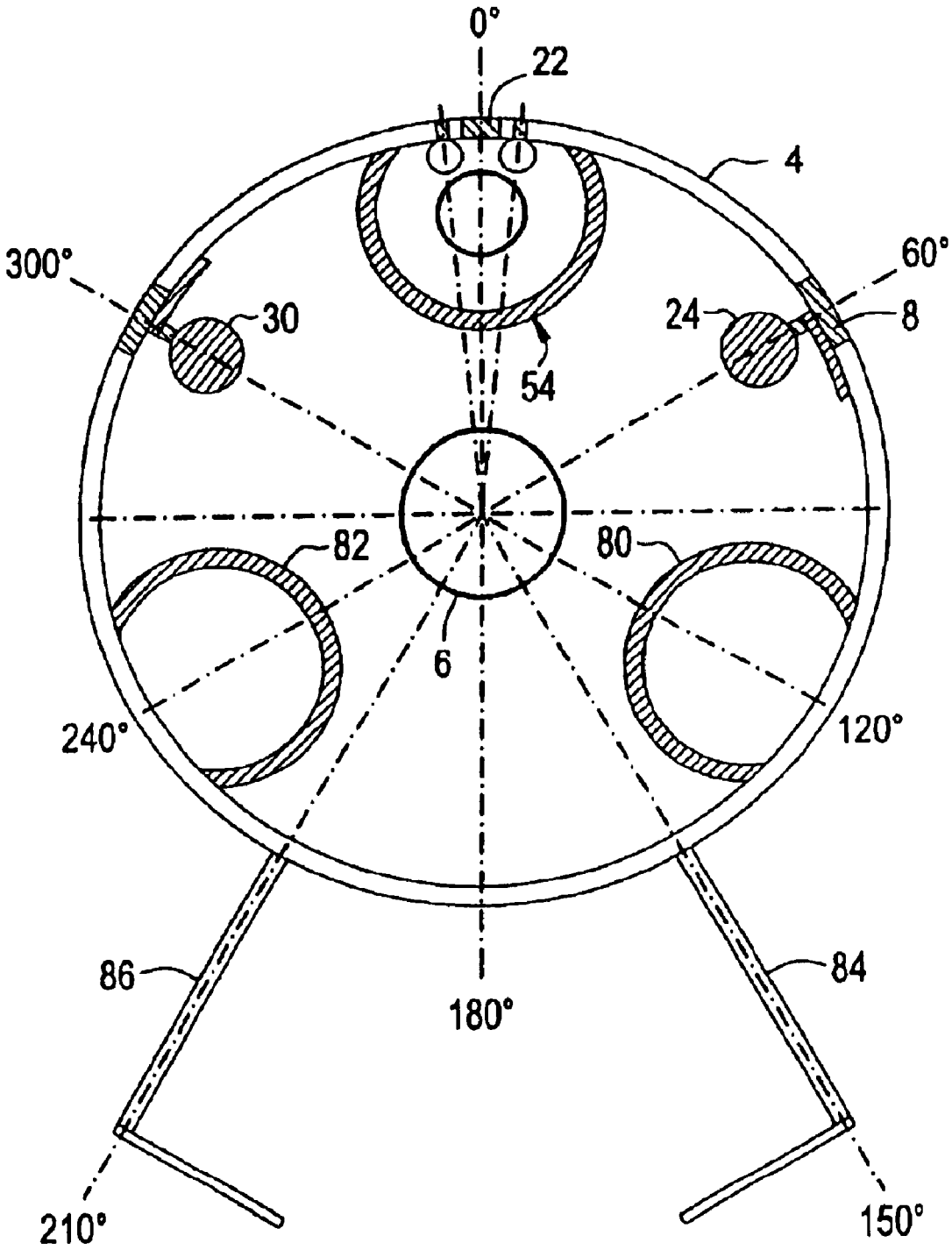
FIG. 5 is a top view of a second embodiment of the common aperture slotted coaxial antenna of the present invention.

Referring now to FIG. 5, there is shown a third embodiment of the common aperture slotted coaxial antenna design of the present invention. In this configuration, orientation of the VHF coupled slot 8 and associated coupler 24 is rotated approximately 60 degrees to the left or right of its position shown in FIG.

In addition to a change in orientation, the present embodiment presents changes to the number of VHF couplers and UHF antennas. More specifically, the number of VHF couplers have been reduced from four in FIG. 1 to two 24, 30, which are positioned at approximately 60 and 300 degrees, respectively, as shown in FIG. 5.

Similarly, FIG. 5 shows a reduction in the number of UHF antennas from four in FIG. 1 to one 54, which is positioned at zero degrees. To maintain symmetry within the hollow mast 4, as well as to balance the VHF couplers, two empty tubes 80, 82, positioned at 120 and 240 degrees, respectively, are included. Note that there are no slots in the periphery of the mast 4 associated with each empty tube 80, 82.

Figure 6:
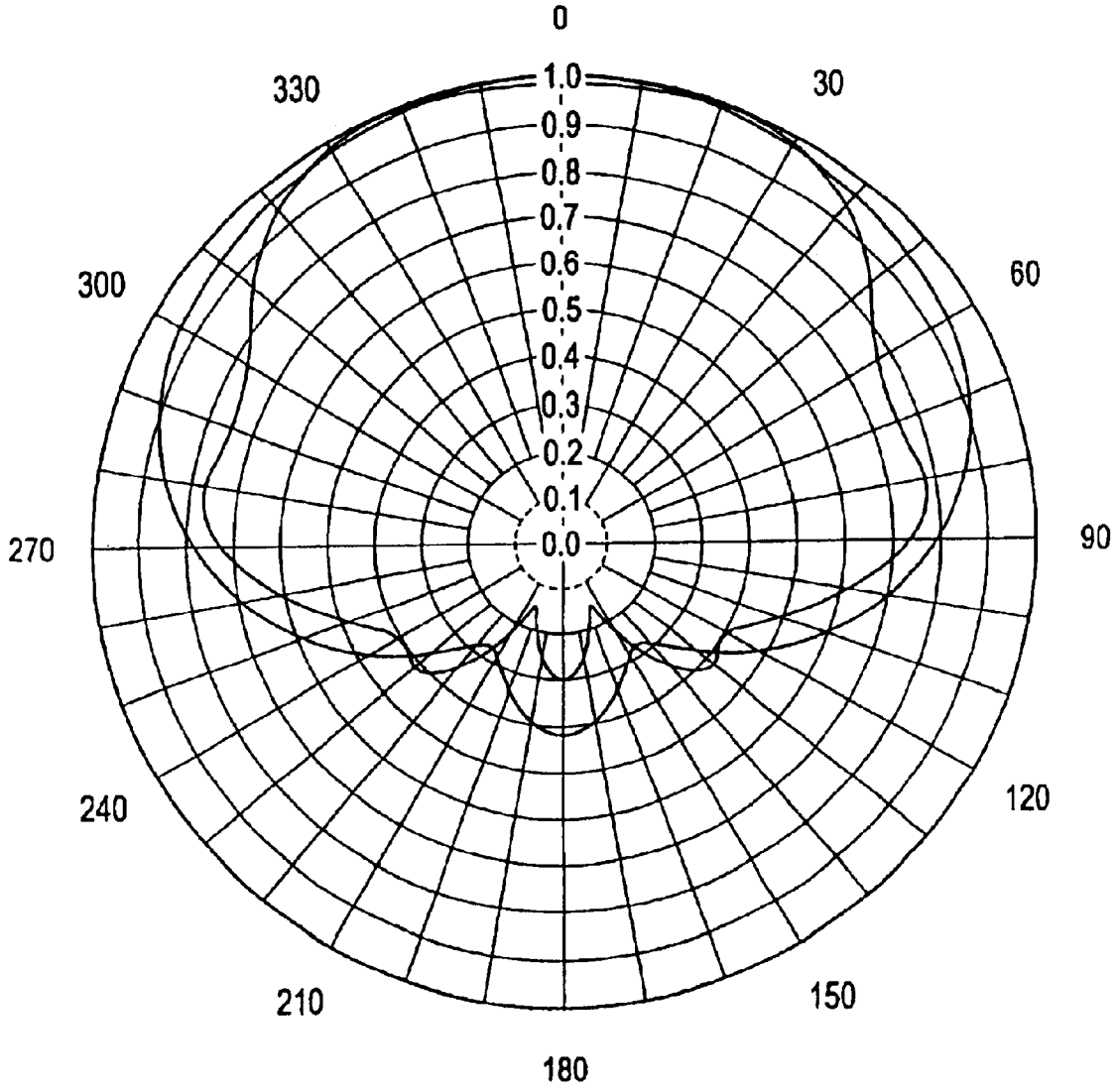
FIG. 6 is a graph depicting UHF and VHF azimuth patterns corresponding to the slotted coaxial antenna design of FIG. 5.

Finally, fins 84, 86, positioned approximately at 150 and 210 degrees, respectively, are included in this configuration for the purpose of shaping the azimuth patterns of both the VHF and UHF radiating frequencies as desired. The azimuth pattern corresponding to the slotted coaxial antenna design of FIG. 5 is shown in FIG. 6.

Figure 7:
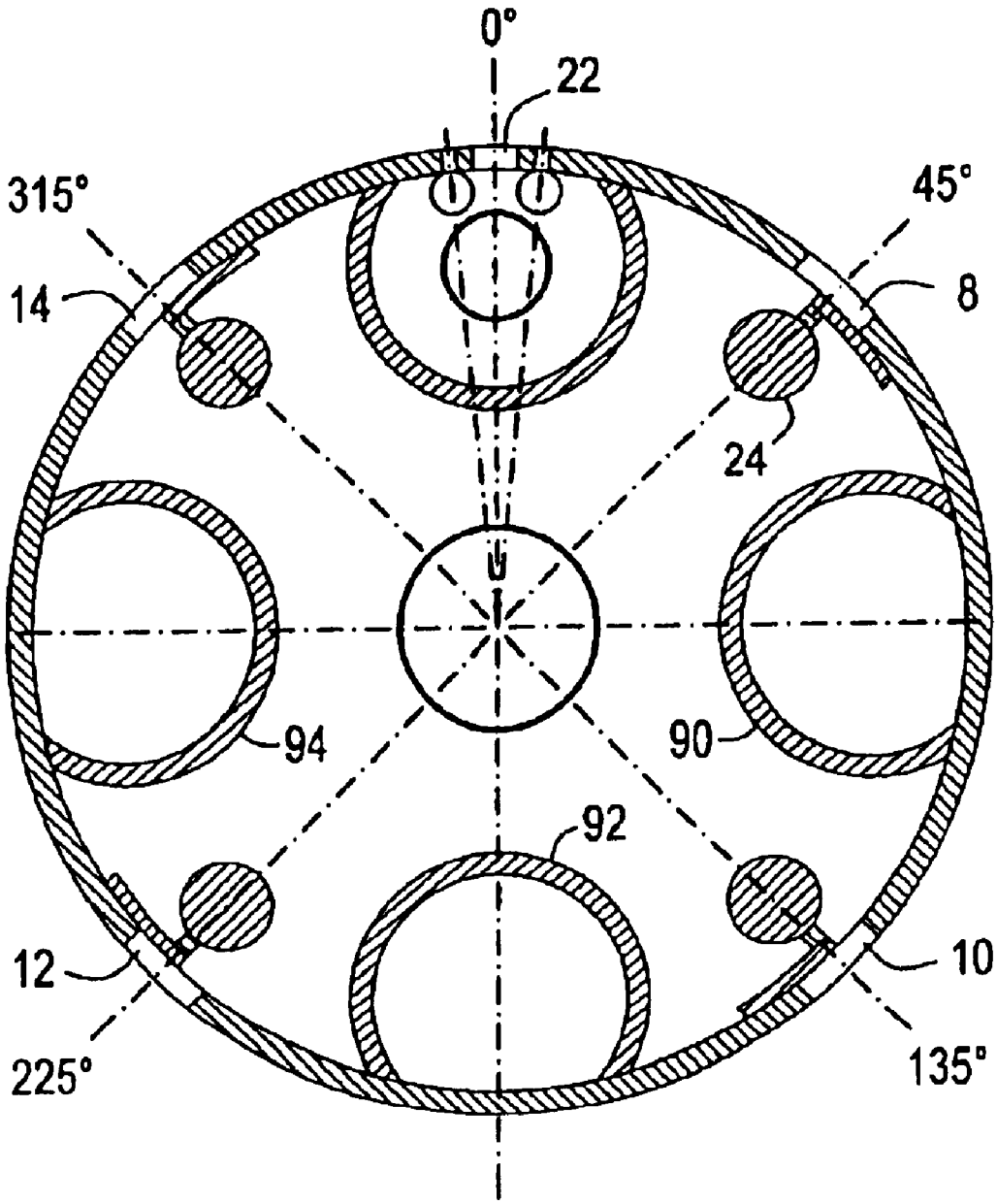
FIG. 7 is a top view of a third embodiment of the common aperture slotted coaxial antenna of the present invention.

Referring to FIG. 7, there is shown a top view of a third embodiment of the common aperture slotted coaxial antenna of the present invention. In this configuration, orientation of the VHF coupled slot 8 and associated coupler 24 is rotated approximately 45 degrees to the left or right of its position shown in FIG. 1.

Figure 8:
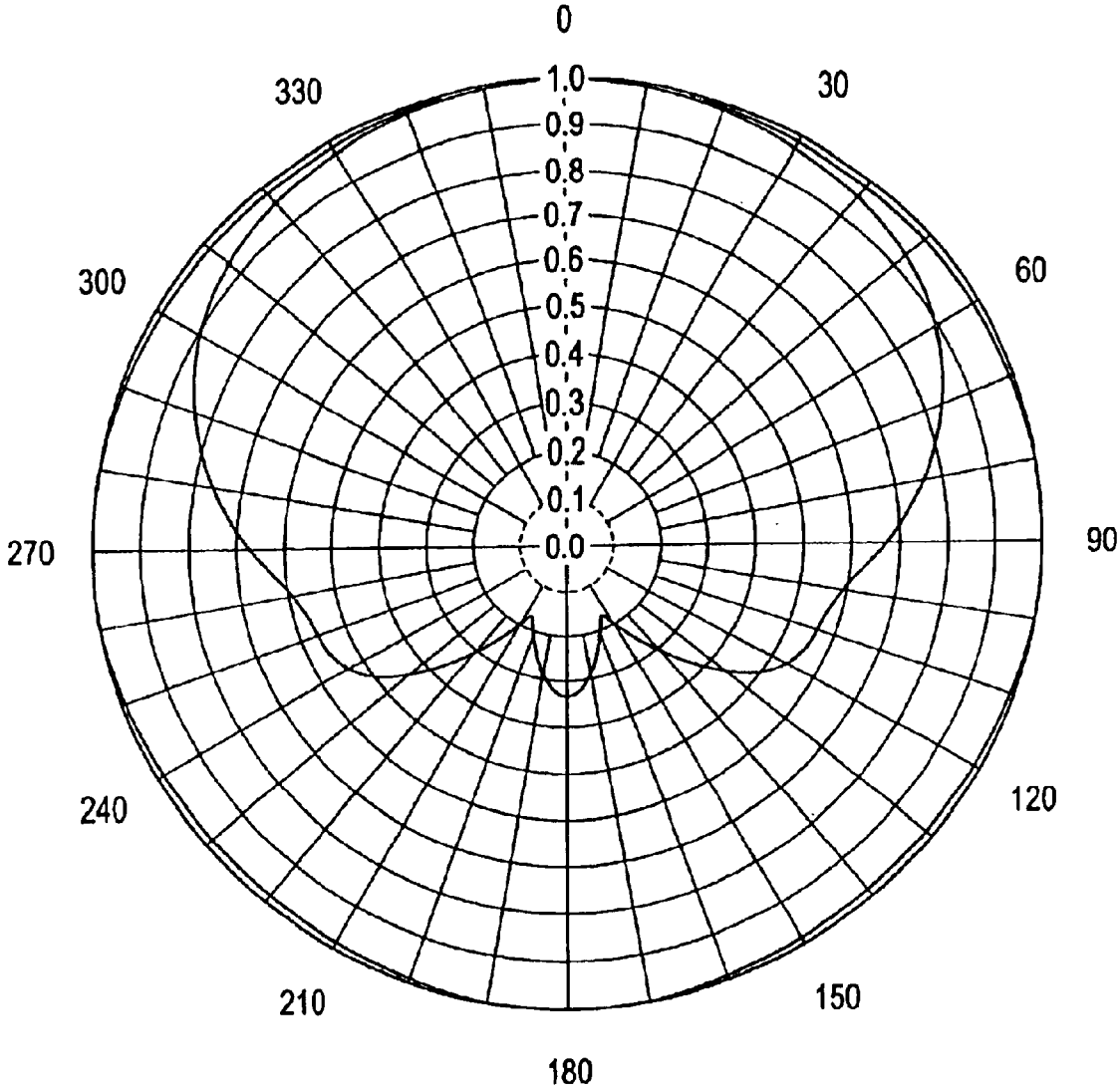
FIG. 8 is a graph depicting UHF and VHF azimuth patterns corresponding to the slotted coaxial antenna design of FIG. 7.

For instance, if VHF coupled slot 8 is rotated approximately 45 degrees to the right, then all four VHF coupled slots 8, 10, 12, 14 are positioned at 45, 135, 225 and 315 degrees, respectively. Accordingly, UHF coupled slot 22 is also shifted 45 degrees to the right, such that it is positioned at zero degrees. Empty tubes 90, 92, 94 are positioned at 90, 180 and 270 degrees, respectively. The azimuth pattern corresponding to the slotted coaxial antenna design of FIG. 7 is shown in FIG. 8.

Figure 9:
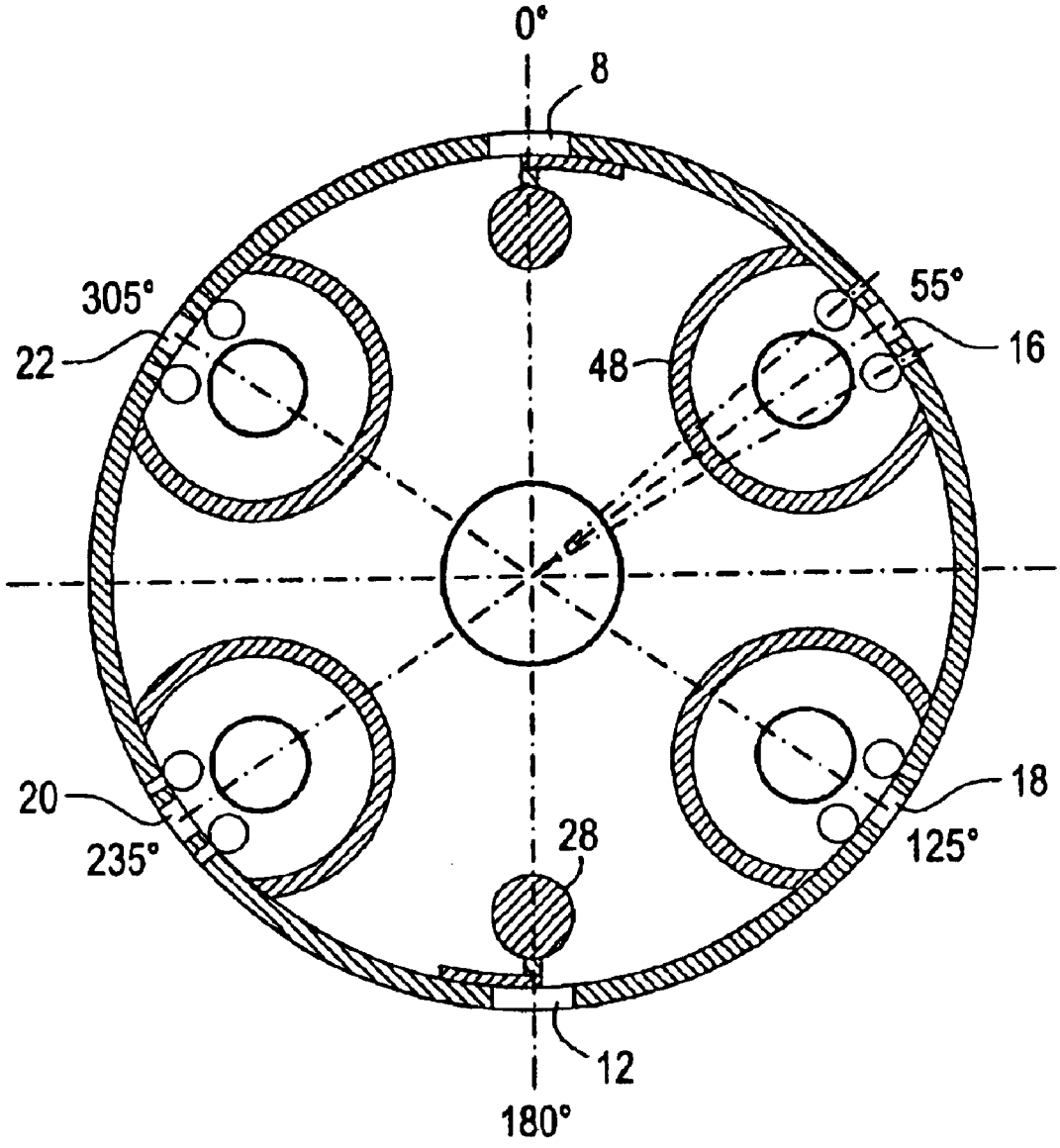
FIG. 9 is a top view of a fourth embodiment of the common aperture slotted coaxial antenna of the present invention.

Referring to FIG. 9, there is shown a top view of a fourth embodiment of the common aperture slotted coaxial antenna of the present invention. In this configuration, orientation of the VHF coupled slot 8 and associated coupler 24 remains at the zero degree position, but each UHF coupled slot 16, 18, 20, 22 is positioned approximately 55 degrees apart; namely, at 55, 125, 235 and 305 degrees, respectively.

Figure 10:
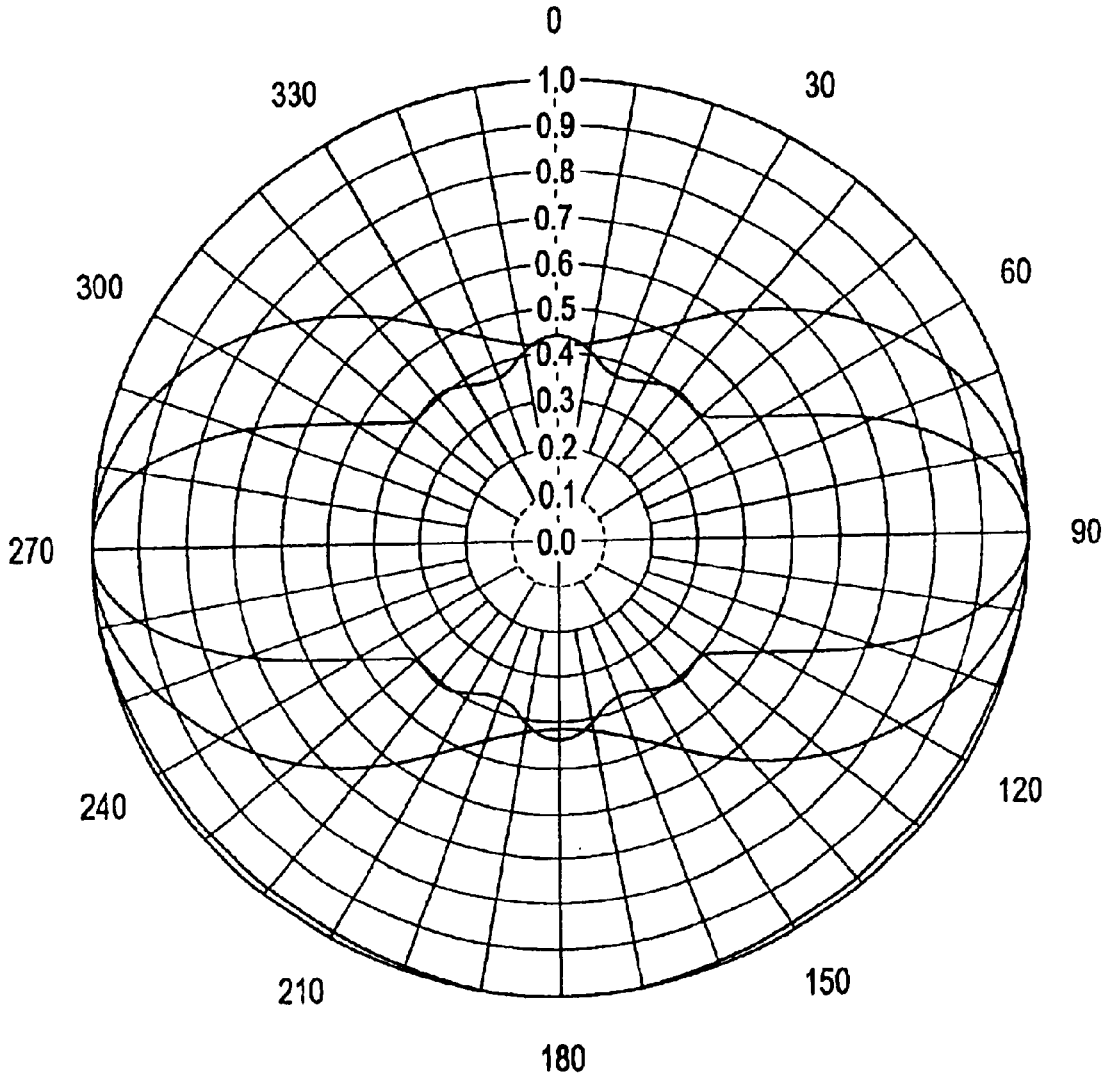
FIG. 10 is a graph depicting UHF and VHF azimuth patterns corresponding to the slotted coaxial antenna design of FIG. 9.

In addition to a change in orientation, the present embodiment presents changes to the number of VHF couplers. More specifically, the number of VHF couplers have been reduced from four in FIG. 1 to two 24, 28, which are positioned at approximately zero and 180 degrees, respectively, as shown in FIG. 9. The azimuth pattern corresponding to the slotted coaxial antenna design of FIG. 9 is shown in FIG. 10.

Figure 13:
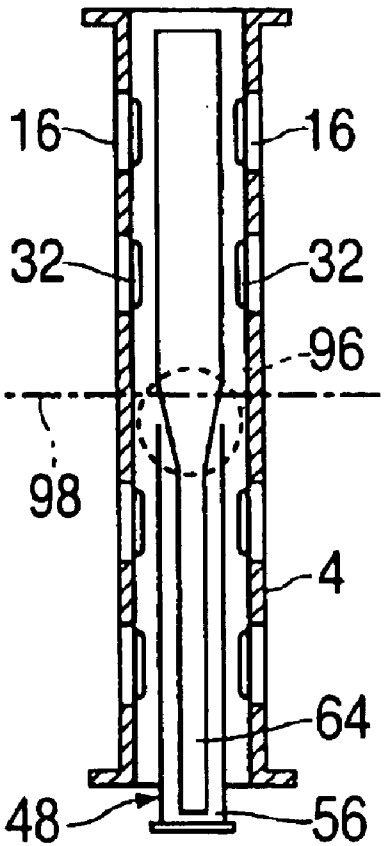
FIG. 13 is a front elevation view of a slotted coaxial antenna of the present invention.
Figure 12:
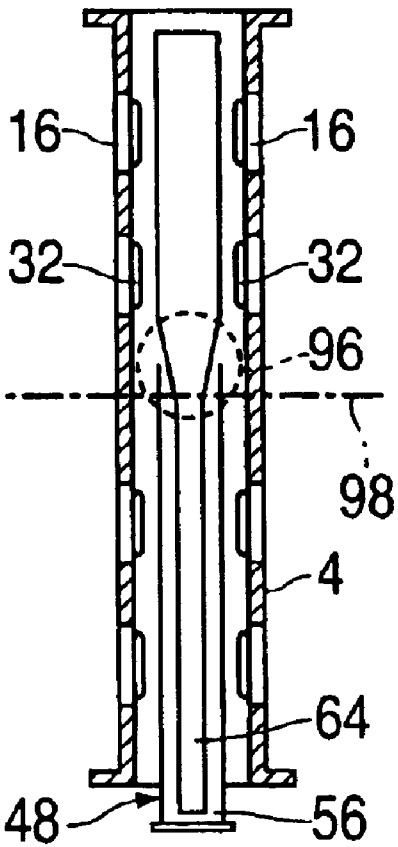
FIG. 12 is a front elevation view of a slotted coaxial antenna of the present invention.
Figure 11:
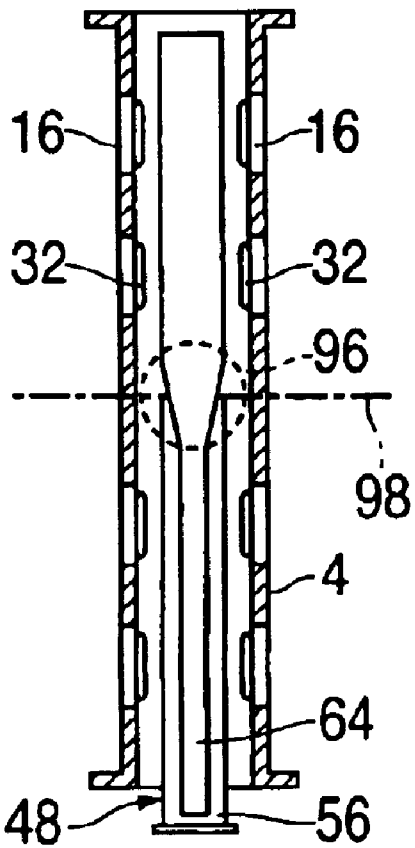
FIG. 11 is a front elevation view of a slotted coaxial antenna of the present invention.

FIGS. 11–13 illustrate how the beam tilt of any one of the UHF antennas 48, 50, 52, 54 can be adjusted by varying a feed point 96 of the desired UHF antenna 48, 50, 52, 54. When a power divider, such as power divider 72 shown in FIG. 3, is utilized to separately feed each UHF antenna 48, 50, 52, 54, each UHF antenna operates independently from the other UHF antennas. Thus, the beam tilt of a single UHF antenna 48, 50, 52, 54 can be varied without varying the beam tilts of the other UHF antennas. Accordingly, the distance from the antenna where the relative power, for example, the maximum power, of the radiated signal strikes the ground is changed when the beam tilt is adjusted.

In an exemplary embodiment of the present invention, as shown in FIG. 11, UHF antenna 48, for example, has a beam tilt of zero degrees when the feed point of the inner conductor 64 is at the center line 98 (i.e., between the upper portion and the lower portion), as shown in FIG. 11.

In an exemplary embodiment of the present invention, as shown in FIG. 12, the beam tilt is increased when the feed point is moved above the center line 98 (i.e., when the electrical feed point is biased toward the upper portion) of an antenna in accordance with the present invention.

In another exemplary embodiment of the present invention as shown in FIG. 13, the beam tilt is decreased when the feed point is moved below the center line 98 (i.e., when the electrical feed point is biased towards the lower portion) of an antenna in accordance with the present invention.

When the beam tilt of an individual UHF antenna, for example UHF antenna 48, is adjusted, the elevation pattern of UHF antenna 48 may be changed, but the azimuth pattern of UHF antenna 48 remains the same. UHF antenna 48 is essentially divided into two portions when the antenna is fed at a feed point 96 between the two ends of UHF antenna 48. When the feed point 96 is at the center line 98, the energy of the signal is equally distributed between the upper portion and the lower portion of the UHF antenna 48. Accordingly, the energy radiates from the upper portion of the antenna and lower portion of the antenna and each portion generates, for example, an omni-directional azimuth pattern. It should be understood that the upper portion and the lower portion are not limited to generating omni-directional azimuth patterns.

Figure 14:
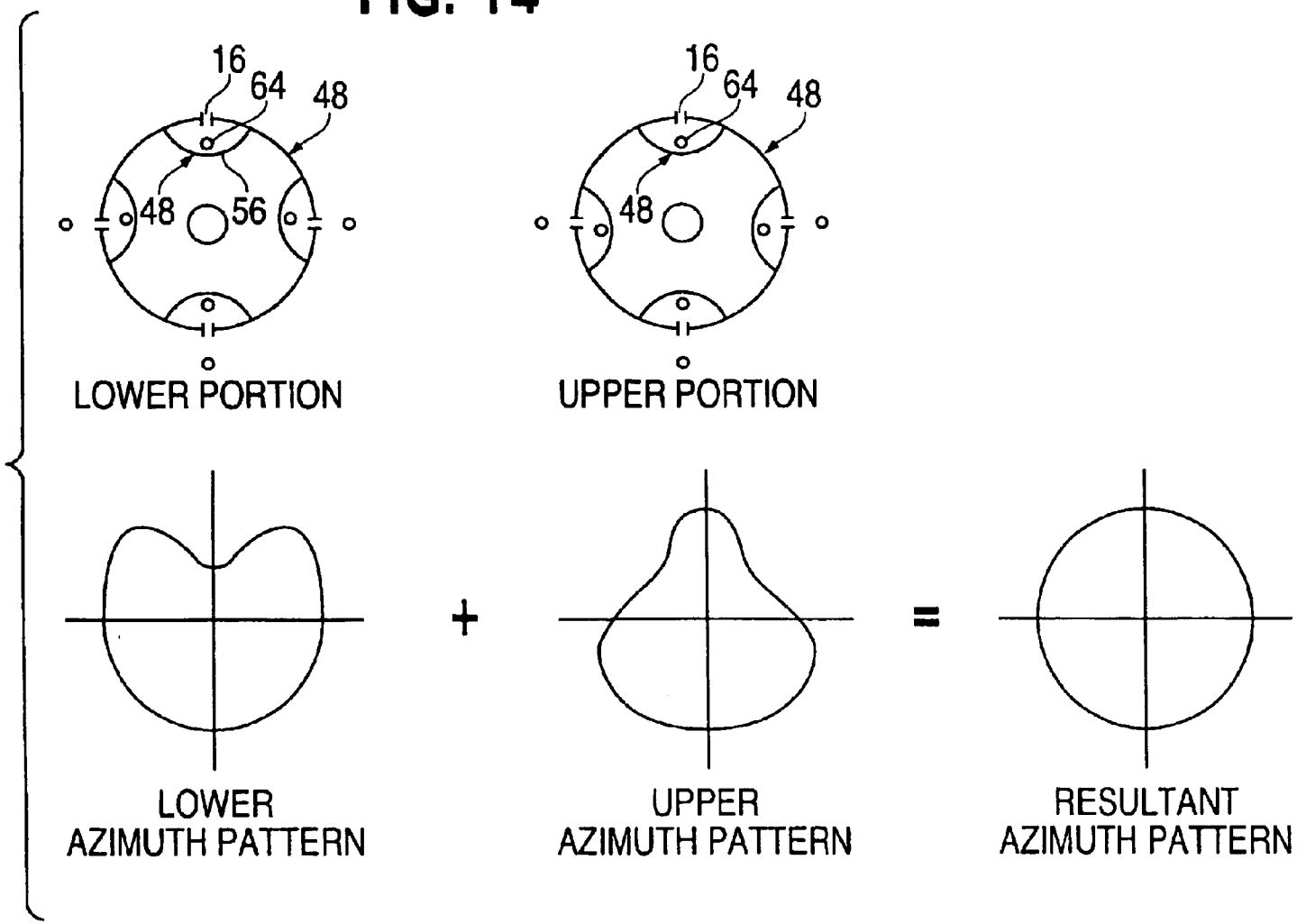
FIG. 14 illustrates cross-sections and azimuth patterns of a slotted coaxial antenna of the present invention.

When the feed point is moved above the center line 98 to increase the beam tilt, the azimuth pattern of the upper portion of the UHF antenna 48 is going to change and the azimuth pattern of the lower portion of UHF antenna 98 is going to change because the energy is no longer distributed evenly. For example, when the feed point is moved above the center line 98, the energy distributed from the lower portion of the UHF antenna 48 may be less than the energy distributed from the upper portion of the UHF antenna 48. Thus, as shown in FIG. 14, the lower portion of the antenna will radiate less by the amount that the upper portion of the antenna radiates more, because although the distribution of the energy changes, the total amount of energy radiated by the UHF antenna does not change. Accordingly, as shown in FIG. 14, when the azimuth patterns generated from the upper and lower portions of the antenna are added together, the resultant antenna pattern is, for example, the original omni-directional azimuth pattern. It should be understood that the original azimuth pattern may not be omni-directional.

Thus, whether the beam tilt of an individual UHF antenna is increased or decreased, the resulting azimuth pattern of the individual UHF antenna will remain the same although its elevation pattern may be altered. Accordingly, the resulting azimuth pattern from the sum of the individual UHF antennas will also remain the same.

It is now apparent that the antenna system design of the present invention has a number of features and advantages over the prior art, particularly in respect to increased broadband bandwidth capabilities, minimal tower wind loading, and improved antenna output response performance suitable for both digital TV transmission systems and NTSC antenna systems, etc.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna comprising:

a mast having an upper portion and a lower portion;

a VHF coupled slot in an outer periphery of the mast, and fed from a VHF inner conductor positioned within the mast;

a UHF coupled slot in the outer periphery of the mast, and fed independently from the VHF coupled slot by a first UHF inner conductor positioned within the mast; and a first feed point to the UHF inner conductor, wherein the location of the first feed point is between the upper half and the lower half.

2. The antenna of claim 1, wherein the first feed point is within the lower portion of the antenna.

3. The antenna of claim 1, wherein the first feed point is within the upper portion of the antenna.

4. The antenna of claim 1, wherein the first feed point is located at a center line of the antenna.

5. The antenna of claim 1, wherein the upper portion of the antenna and the lower portion of the antenna are fed in opposite directions.

6. The antenna of claim 1, wherein the UHF coupled slot is one of a plurality of UHF coupled slots arranged in at least two columns of UHF coupled slots.

7. The antenna of claim 6, further comprising:

a second UHF inner conductor having a second feed point; and a power divider, wherein the power divider divides the UHF input between the first UHF inner conductor and a second UHF inner conductor.

8. The antenna of claim 7, wherein the first UHF inner conductor is coupled to one of the at least two columns of UHF coupled slots, and the second UHF inner conductor is coupled to the other of the at least two columns of UHF coupled slots.

9. The antenna of claim 8, wherein the first feed point and the second feed point are individually adjustable between the upper portion of the antenna and the lower portion of the antenna.

10. The antenna of claim 1, wherein when the feed point is moved between the upper portion and the lower portion, an elevation pattern of the antenna is adjustable.

11. An antenna, comprising:

a mast;

means for transmitting a VHF signal, wherein the VHF transmitting means is positioned within the mast;

means for transmitting a UHF signal separately from the VHF signal, wherein the UHF transmitting means is positioned within the mast;

means for dividing the antenna into an upper portion and to a lower portion; and means for feeding the UHF signal to the upper portion and to the lower portion of the antenna.

12. The antenna of claim 11, wherein a location of the dividing means is variable.

13. The antenna of claim 11, wherein the UHF transmitting means is a UHF inner conductor.

14. The antenna of claim 11, wherein the dividing means is a feed point.

15. The antenna of claim 11, wherein the feeding means is a transmission line.

16. The antenna of claim 11, further comprising a means for dividing the UHF signal into at least a first UHF signal and a second UHF signal.

17. The antenna of claim 16, wherein the UHF dividing means is a power divider.

18. A method for transmitting signals from an antenna, comprising:

transmitting a VHF signal and a UHF signal simultaneously and separately from the antenna;

dividing the antenna into an upper portion and a lower portion;

feeding the UHF signal to the upper portion and the lower portion of the antenna; and varying a feed point for the UHF signal between the upper portion and the lower portion.

19. The method according to claim 18, wherein the feed point is in the upper portion of the antenna.

20. An antenna, comprising:

a mast;

a first inner conductor positioned within the mast having a first feed point that is adjustable between an upper portion and a lower portion of the antenna; and a second inner conductor positioned within the mast having a second feed point that is adjustable between an upper portion and a lower portion of the antenna.

21. The antenna of claim 20, wherein the first inner conductor and the second inner conductors are UHF inner conductors.

* * * * *